US009482098B2

(12) United States Patent
Quach et al.

(10) Patent No.: US 9,482,098 B2
(45) Date of Patent: Nov. 1, 2016

(54) CONVECTIVE SHIELDING COOLING HOLE PATTERN

(75) Inventors: San Quach, East Hartford, CT (US); Steven Bruce Gautschi, Naugatuck, CT (US); Christina E. Botnick, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 668 days.

(21) Appl. No.: 13/469,647

(22) Filed: May 11, 2012

(65) Prior Publication Data

US 2013/0302141 A1 Nov. 14, 2013

(51) Int. Cl.
*F01D 5/14* (2006.01)
*F01D 5/18* (2006.01)

(52) U.S. Cl.
CPC ..... *F01D 5/145* (2013.01); *F01D 5/187* (2013.01); *F05D 2240/81* (2013.01); *F05D 2250/23* (2013.01); *F05D 2250/231* (2013.01); *F05D 2250/232* (2013.01); *F05D 2250/324* (2013.01); *F05D 2260/201* (2013.01)

(58) Field of Classification Search
CPC ..... F01D 5/18; F01D 5/085; F01D 5/087; F01D 5/08; F05D 2250/23; F05D 2250/324; F05D 2250/231; F05D 225/232; F05D 2240/81; F05D 2260/201
USPC ..... 416/95, 96 R, 97 R, 193 R, 193 A
See application file for complete search history.

(56) References Cited

U.S. PATENT DOCUMENTS

| | | | | |
|---|---|---|---|---|
| 5,382,135 | A * | 1/1995 | Green | 416/97 R |
| 6,120,249 | A * | 9/2000 | Hultgren et al. | 416/97 R |
| 6,616,405 | B2 * | 9/2003 | Torii et al. | 416/97 R |
| 7,766,606 | B2 * | 8/2010 | Liang | 415/115 |
| 2002/0076324 | A1 * | 6/2002 | Abuaf et al. | 416/1 |
| 2002/0090295 | A1 | 7/2002 | Torii et al. | |
| 2008/0149205 | A1 | 6/2008 | Gupta et al. | |
| 2010/0232975 | A1 * | 9/2010 | Morris et al. | 416/232 |

FOREIGN PATENT DOCUMENTS

EP 1688587 A2 5/2006

OTHER PUBLICATIONS

Acharya, et al., "Turbine Blade Aerodynamics", The Gas Turbine Handbook; Jan. 2006; pp. 363-386.
Supplementary European Search Report; Date of Mailing Apr. 8, 2016; 38 pages.

* cited by examiner

*Primary Examiner* — Richard Edgar
*Assistant Examiner* — Brian P Wolcott
(74) *Attorney, Agent, or Firm* — Cantor Colburn LLP

(57) ABSTRACT

The cooling system for a turbine may include a plurality of platform cooling openings positioned in a platform of the turbine airfoil. In particular, the first set of cooling openings may create a first cooling path and a second set of cooling openings may be placed in the path of the first cooling path where the first cooling flow will cool the second set of cooling openings.

17 Claims, 9 Drawing Sheets

CONVECTIVE SHIELDING COOLING HOLE PATTERN

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

SUMMARY

A turbine airfoil cooling system for a turbine airfoil used in turbine engines is disclosed. In particular, the turbine airfoil cooling system includes a plurality of internal cavities positioned between outer walls of the turbine airfoil. The cooling system may include a plurality of platform cooling openings positioned in a platform of the turbine airfoil. In particular, the first set of cooling openings may create a first cooling path and a second set of cooling openings may be placed in the path of the first cooling path where the first cooling flow will cool the second set of cooling openings. In addition, the second set of cooling openings may create a second cooling path and additional cooling openings may be placed in the path of previous cooling paths, where the "upstream" cooling flows will provide cooling to the "downstream" cooling openings. In addition, the removal of material from the platform results in the platform weighing less. As the platform weighs less, engine performance will improve.

During use, cooling medium may flow into the cooling system from a cooling medium supply source. The cooling medium may reduce the temperature of the platform and local hot spot. The cooling medium may be exhausted through the downstream edge of the platform. The cooling medium may be a fluid and may form a layer of film cooling air immediately proximate to the outer surface of the platform. This configuration of the cooling system cools the platform with both external film cooling and internal convection. As a result, cooling fluids that cool internal aspects of the platform with convective cooling also will cool external surfaces of the platform with convective film cooling. Such use of the cooling fluids increases the efficiency of the cooling fluids and reduces the temperature gradient of the platform across its width. A potential additional benefit is that the more consistent cooling may allow the platform to be created from less exotic materials that may be less costly.

Another advantage is that the first cooling openings provide a cooling flow to additional cooling openings such that the temperature at the additional cooling opening will be lower. Thus, the additional cooling openings will not have to cool such high temperatures. In addition, the cooling flows from the additional cooling openings will be cooler and will be more effective at later cooling openings. Thus, hot spots on the platform may be reduced resulting in more consistent cooling across the entire platform which will result in a longer life for the platform. This use of cooling opening improves the overall platform cooling efficiency, provides more consistent platform temperatures, reduces the platform metal temperature, reduces platform weight and reduces cooling fluid consumption. These and other embodiments are described in more detail below.

SPECIFICATION

Figure 1:
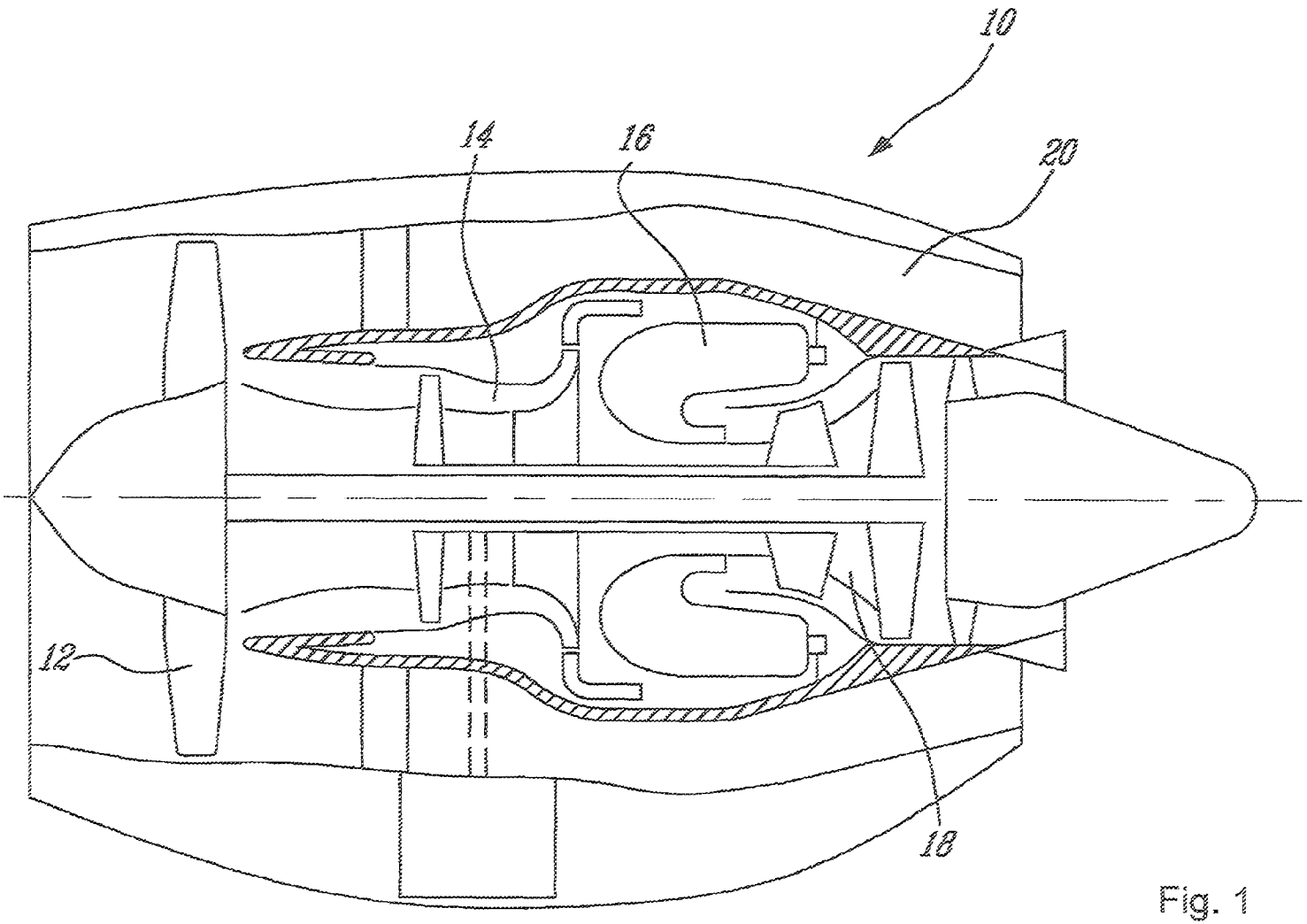
FIG. 1 may illustrate a sample turbine engine.

FIG. 1 may illustrate a turbofan gas turbine engine 10 of a type preferably provided for use in subsonic flight, generally including a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. In the illustrated arrangement, by-pass air flows longitudinally around the engine core through a by-pass duct 20 provided within the nacelle.

Figure 2:
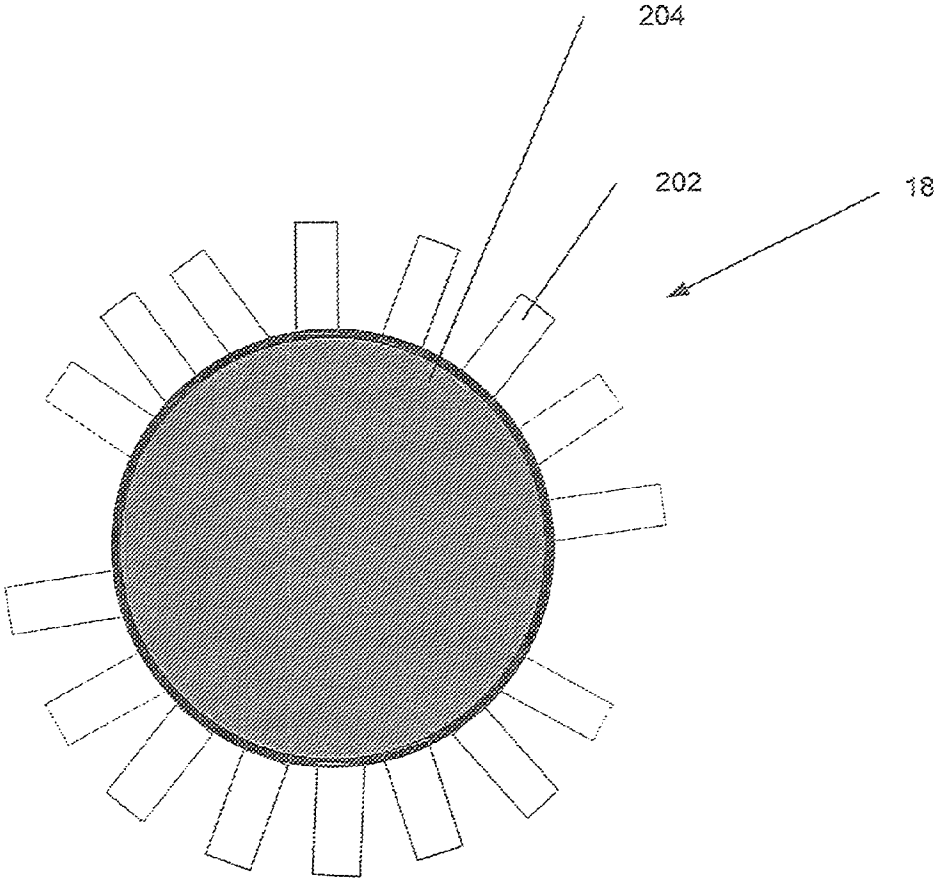
FIG. 2 may illustrate a sample turbine with airfoils.
Figure 2A:
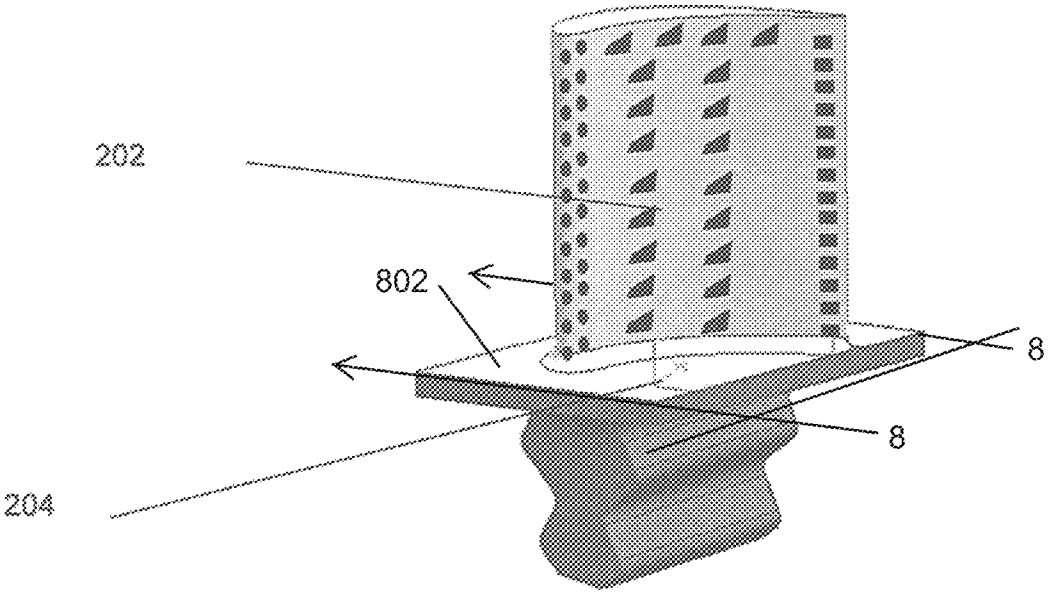
FIG. 2*a* may illustrate a sample airfoil and platform.

FIG. 2 may illustrate a sample turbine rotor. The turbine 18 may have a plurality of airfoils 202 that may be in communication with a platform 204. FIG. 2*a* may illustrate an airfoil 202. The airfoil 202 may be formed from a generally elongated, possibly hollow airfoil 202 coupled to a platform 204. The platform 204 may include a top surface 802. The turbine airfoil 202 may be formed from conventional metals or other acceptable materials. The turbine may be casted or milled or may be a combination of parts that are cast or milled. Some parts such as the platform 204 may be of a first material such as a metal and the airfoils 202 may be of a second material or a metal that have different characteristic than the first material.

Figure 3:
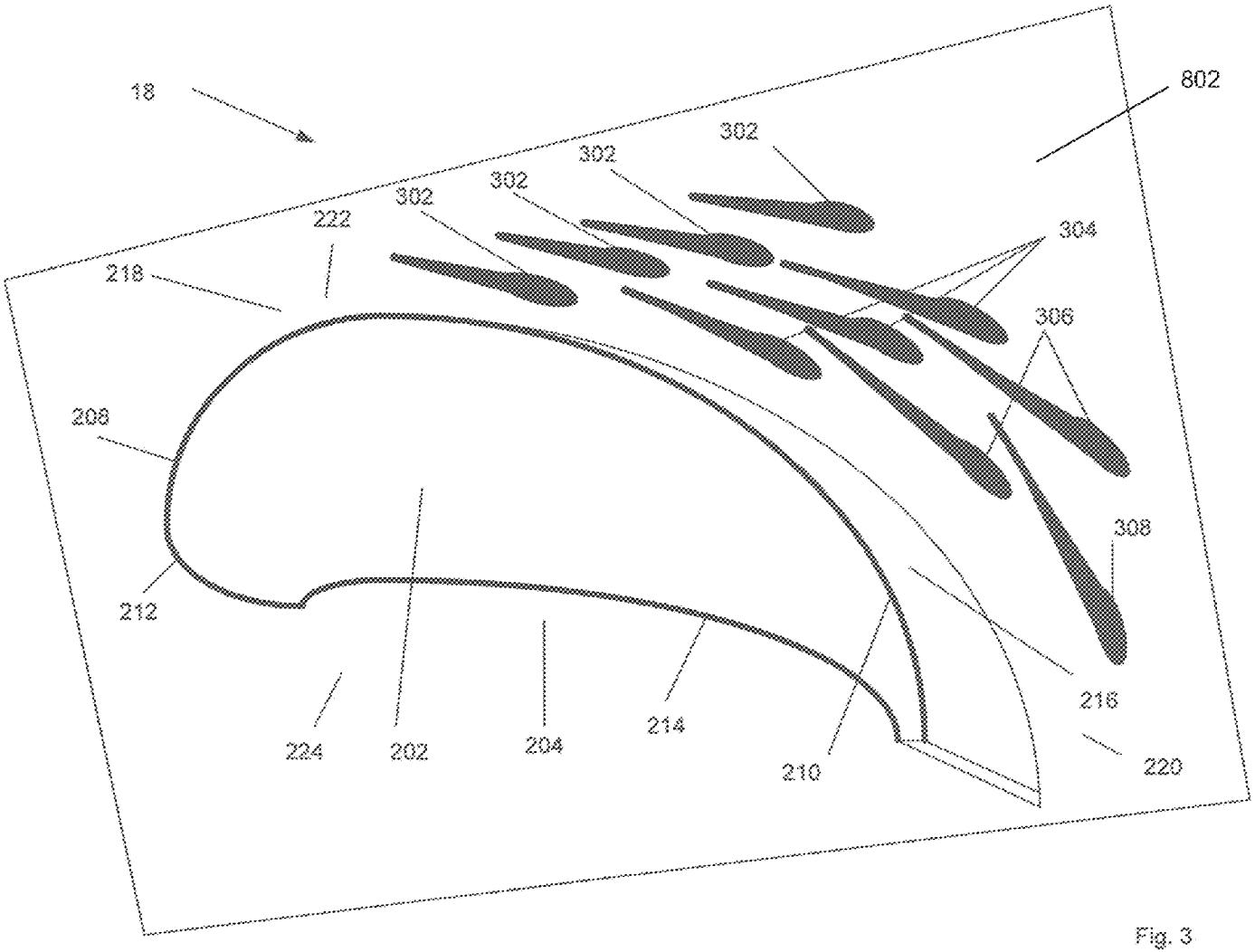
FIG. 3 may illustrate a sample cooling opening arrangement.
Figure 4A:
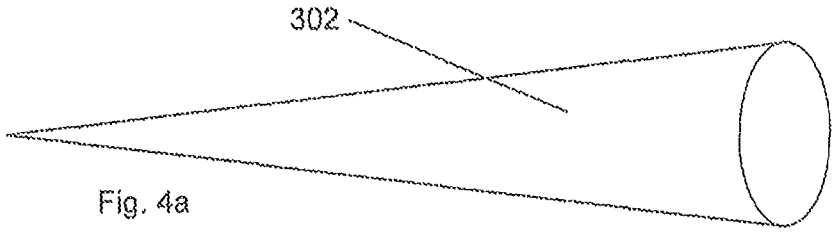
FIGS. 4*a*-4*d* may illustrate some sample cooling opening shapes.
Figure 4B:
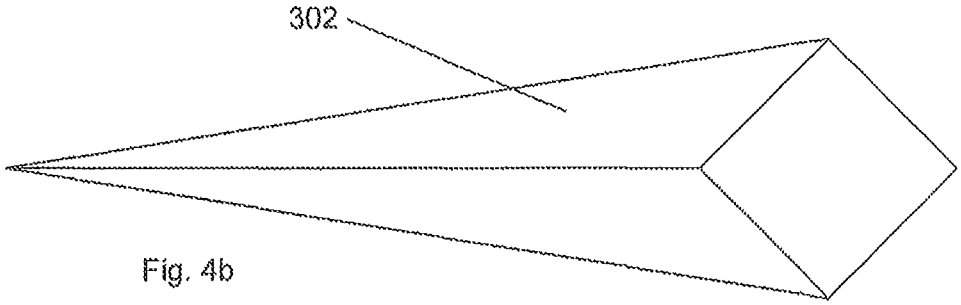
Figure 4C:
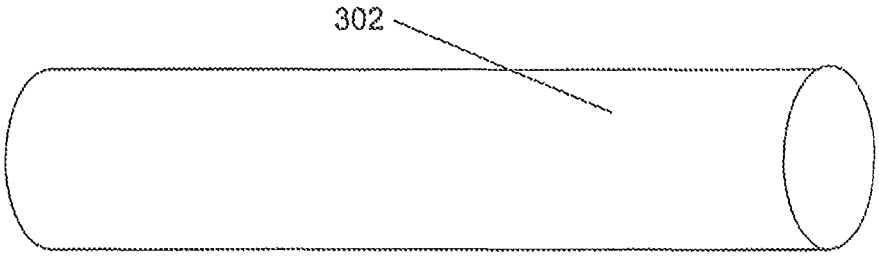
Figure 4D:
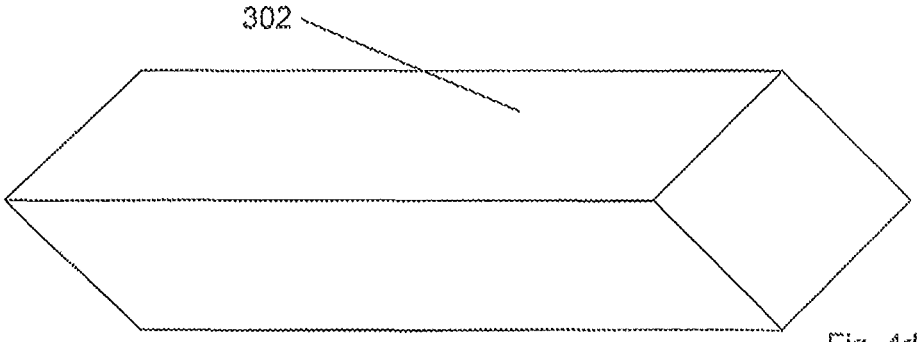

FIG. 3 may illustrate one specific airfoil 202 and platform 204 in more detail. The airfoil 202 may extend from the top surface 802 of the platform 204 to a tip section (not shown in this two dimensional drawing) and include a leading edge 208 and a trailing edge 210. The airfoil 202 may have an outer wall 212 adapted for use, for example, in a first stage of an axial flow turbine engine 10 as illustrated in FIG. 1. The outer wall 212 may form a generally concave shaped portion forming a pressure side 214 and may form a generally convex shaped portion forming a suction side 216. The platform 204 may extend from the airfoil 202 upstream to form an upstream edge 218, downstream to form a downstream edge 220 and outwardly to form a first side edge 222 and a second side edge 224.

In FIG. 3, a sample cooling opening arrangement on the top surface 802 of the turbine platform 204 is illustrated. A first set of cooling openings 302 are illustrated as being in the platform 204 on the downstream edge 220 and the suction side 216 which is traditionally a hot spot on the platform 204. However, the location of the first set of cooling openings 302 may be virtually anywhere on the platform 204 as long as there is sufficient room (and need) for additional sets of cooling openings as will be explained.

Figure 5A:
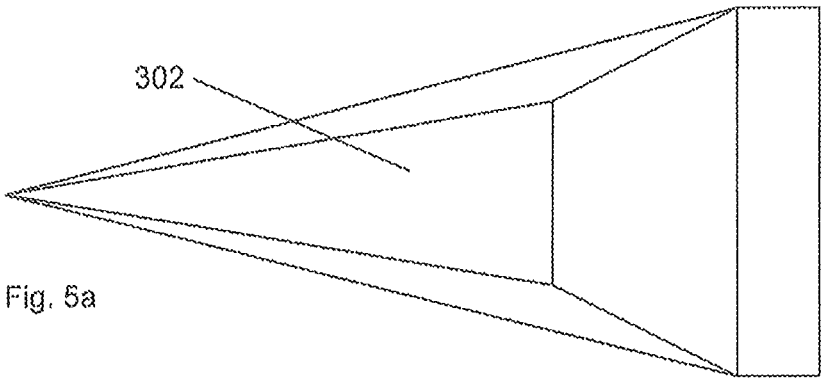
FIGS. 5*a* and 5*b* may illustrate additional cooling opening shapes.
Figure 5B:
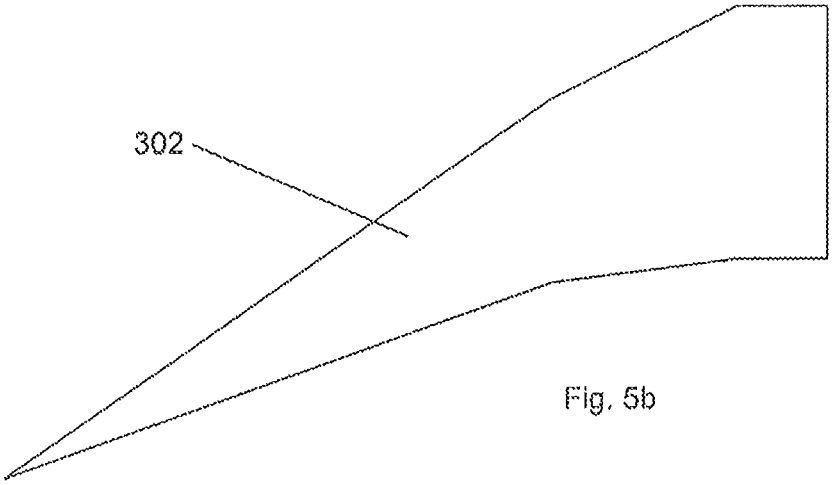

The shape of the cooling openings 302 may take many forms. FIGS. 4*a*-4*d* illustrate some of the many possible forms for the cooling openings 302. In one embodiment, the cooling openings 302 are circular as if they were drilled into the platform 204 using a circular drill. In an additional embodiment as illustrated in FIGS. 5*a*-5*b*, the cooling openings 302 may have a flute or diffused output that may assist in directing the output of the cooling openings. In yet another embodiment, the cooling openings 302 may be machined into virtually any shape such as square, rectangular, triangular, oval, elliptical or any other shape that is desired.

Further, the cooling opening 302 may be created as part of a casting process of the platform 204 which may allow for even more variation, precision and shapes for the cooling openings 302. For example, cores may be shaped to match the desired shape of the cooling opening 302. The cores may be made of compressed sand which may be held together with a binder. The cores may be placed in a mold to create a path for molten metal to flow around and logically, the metal may form around the cores leaving a metallic opening in the shape of the cores.

In other embodiments, wax may be manipulated into a shape of the desired platform 204, including the shape and depth of the cooling openings 302. The mold may be formed around the wax. In some embodiments, the wax may be removed to leave a solid mold. In another embodiment, the wax is left in the mold and when the molten metal is poured into the mold, the wax may burn away leaving a very precise shape for the metal to fill. The result may be a very precise mold and a very precise casting with very precise cooling openings 302.

The path of the cooling openings 302 may have a variety of paths. As illustrated in FIGS. 4*a*-4*d*, the path may be linear as if drilled by a straight and linear drill bit. In another embodiment as illustrated in FIGS. 5*a*-5*b*, the path may be machined to have a curve. In yet another embodiment, the platform 204 may be cast and the cooling openings 302 may be cast in a linear, curved, curvilinear or any logical manner.

Figure 8:
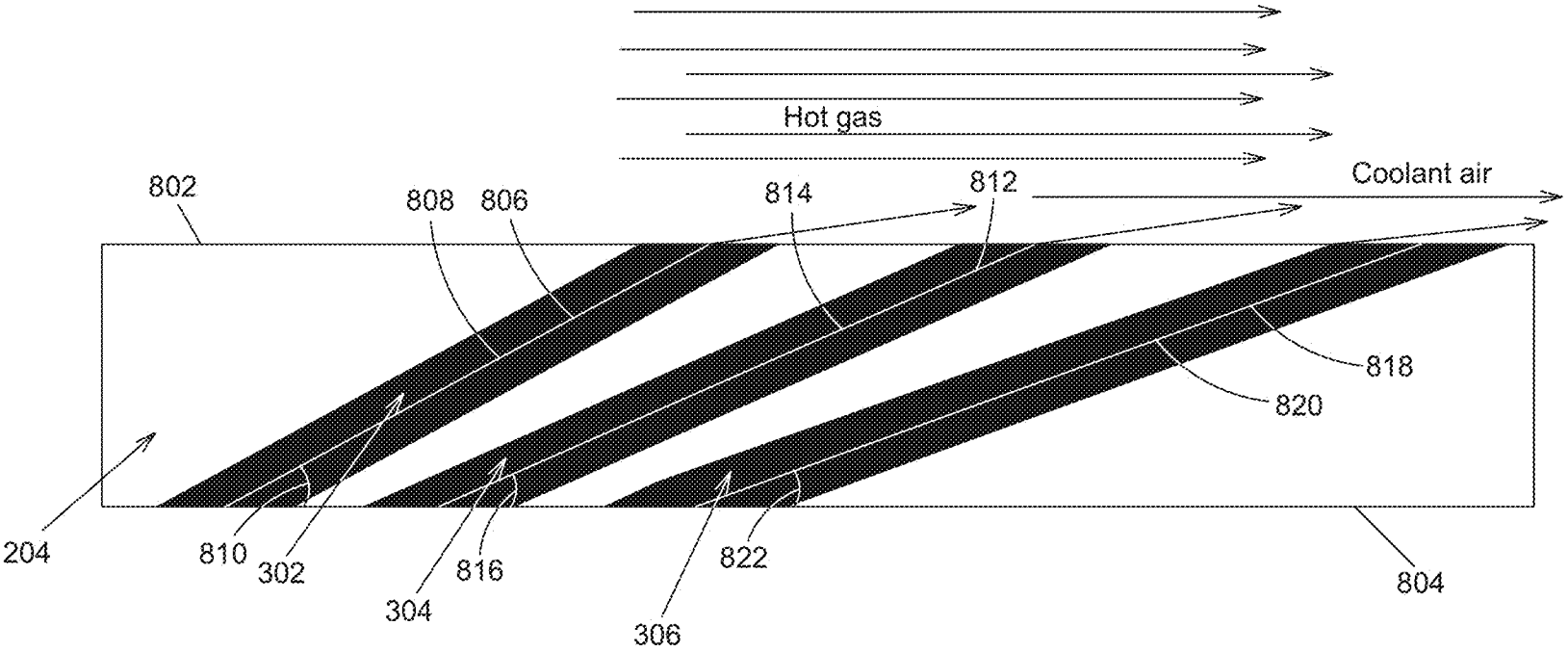
FIG. 8 may illustrate a cut away view of a sample orientation of a set of cooling holes.

The depth of the cooling openings 302 also may be any appropriate depth. The first set of cooling openings 302 may be at a first depth and the second set of cooling openings 304 may be at a second depth where the second may be greater than the first depth. In this way, the cooling medium from the first set of cooling openings 302 may exit the output of the first set of cooling openings 302 before the output from the second set of cooling openings 304. As illustrated in FIG. 8, the pattern of increasing depth of cooling openings 302 may continue along the path of the cooling flow thereby allowing the cooling medium from cooling openings 302 earlier in the flow path to provide cooling medium to cooling openings 304 later in the flow path.

The cooling openings 302 may also proceed to change in width along different lengths of the path. As an example, the paths may start narrow and may widen out as the cooling paths come closer to the surface of the platform 204. In this way, the cooling medium may decelerate as it moves from a smaller opening to a larger opening which may provide additional cooling benefits.

Figure 6:
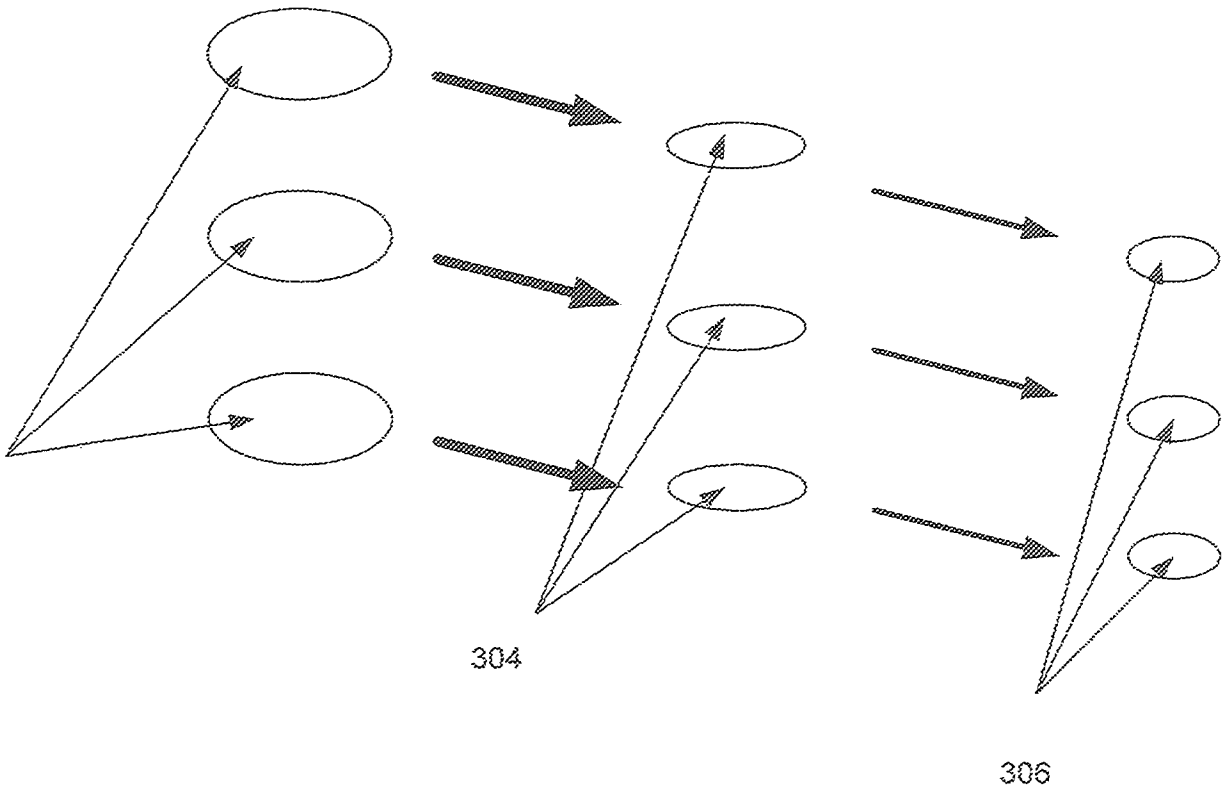
FIG. 6 may illustrate an embodiment of cooling flows.

FIG. 6 may illustrate cooling flows across the sample cooling arrangement. The number of cooling openings 302 may vary. In one embodiment, the number of cooling openings 302 may be reduced in each successive row of cooling openings 302. For example, in FIG. 3, the first row may have four cooling openings 302, the second row may have three cooling openings 304, the third row may have two cooling openings 306 and the fourth row may have one cooling hole 308. In this way, the increased number of cooling openings may provide additional cooling to the reduced number of cooling openings in later rows.

In another embodiment, the cooling openings 302 may be positioned in a way that when the turbine is at its operating speed, the cooling medium will flow from cooling openings in earlier rows over holes in later rows. The position of the cooling openings 302 may be determined through computer simulations or through experiments using actual turbines operating at the desired operating speed to ensure that the cooling medium from previous cooling openings 302 will flow across later cooling openings 304 in the path of the cooling medium. In this embodiment, there may be the same number of cooling openings 302 in each row. In addition, the number of cooling openings 302 may vary based on the flow path in the turbine.

The number of rows of cooling openings may vary depending on a number of factors. If the diameter or surface area of the cooling openings 302 is large, less cooling openings 302 may be needed. If the diameter or surface area of the cooling openings is small, more cooling openings 302 may be needed. In addition, the number and size of the cooling openings 302 may depend on the specific application. For example, some turbine platforms may have few "hot spots" on the platform 204 and the temperature variation from the surrounding area on the may be small. In such cases, fewer cooling openings 302 with fewer rows may be useful. In other examples, a turbine platform 204 may have a large hot spot that may be significantly hotter than its surrounding area. In such a case, more cooling openings 302 with additional rows may be needed.

Figure 7:
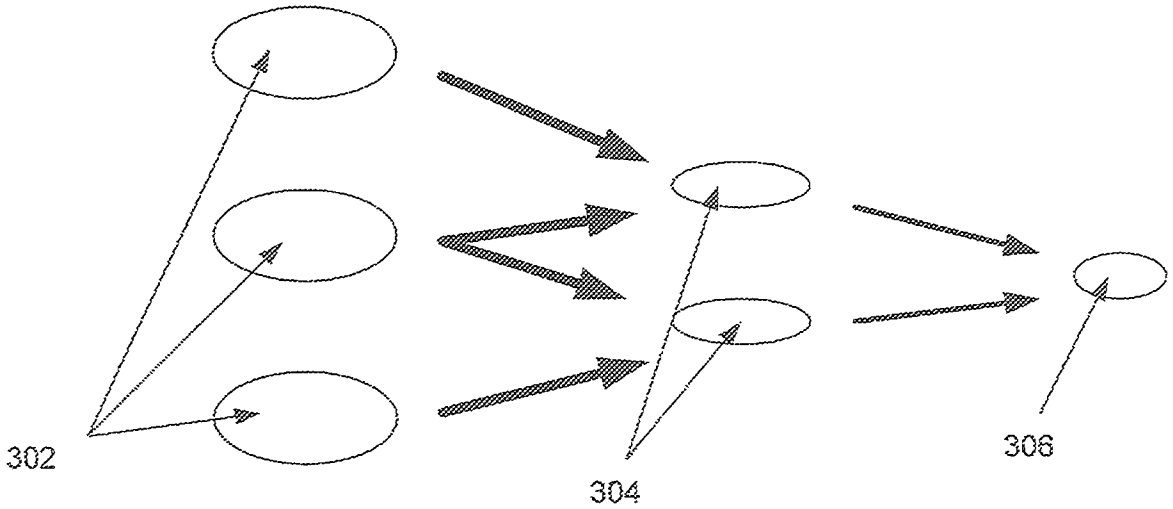
FIG. 7 may illustrate another embodiment of cooling flows.

The rows may be linear or non-linear. Based on a review of the air flow through the turbine 18, it may be useful to have the cooling openings 302 in a non-linear pattern. For example, to provide the desired cooling to later cooling openings 304, the prior cooling openings 302 in the flow pattern may be place in a manner to ensure that the flow from the prior holes 302 flows over the later holes 304 and such placement may not necessarily be linear. The flow path through the turbine may have curves and the cooling openings 302 304 placement may vary based on the curve. FIG. 6 may illustrate a flow path that is relatively linear and FIG. 7 may illustrates a flow path that squeezes the air as it exits the turbine and there is a reduced number of cooling openings 302 in each successive row 304.

FIG. 8 is a cut away illustration of the airflow though the cooling holes along line 8-8 of FIG. 2*a*. The first set of cooling openings 302 may provide cooling openings to the second set of cooling openings 304. Similarly, the second set of cooling openings 304 may provide the cooling medium to the third set of cooling openings 306. Thus, the hot gases may flow by and the cooling openings 302 304 and 306 may provide cooling to keep the hot gases from making the platform 204 as hot as it would be without the cooling openings 302 304 and 306. Also illustrated, as mentioned previously, the length of the cooling openings may increase from the first set of cooling openings 302 to second set of cooling openings 304 and then from the second set of cooling openings 304 to the third set of cooling openings 306, thereby providing great cooling across the platform 204. Accordingly, as seen there, the first set of suction side openings 302 may extend between an inner surface 804 and the top surface 802 of the platform 204. Further, each first suction side opening 302 of the first set of suction side opening 302 may include a first axis 806 that may extend between the inner surface 804 and the top surface 802 of the platform 204 along the center of each first suction side opening 302. Further, each first suction side opening 302 may include a first angle 810, the first angle being defined as the angle between the inner surface 804 of the platform 204 and the first axis 806. Moreover, and still referring to FIG. 8, each second suction side opening 304 of the second set of suction side openings 304 may extend between the inner surface 804 and the top surface of the platform 204 and include a second axis 812 extending between the inner surface 804 and the top surface of the platform 204 along the center of each second suction side opening 304. Further, each such second suction side opening 304 of the set of suction side openings 304 may further include a second angle 816, the second angle being defined as the angle between the inner surface 804 of the platform 204 and the second axis 812, and this second angle 816 may be different than the first angle 810. Additionally, and referring to FIG. 8, each third suction side opening 306 of the third set of suction side openings 306 may extend between the inner surface 804 and the top surface 802 of the platform 204 and include a third axis 818. The third axis 818 may extend between the inner surface 804 and the top surface 802 along the center of such third suction side opening 306. Furthermore, such third suction side opening 306 may include a third angle 822, the third angle 822 being defined as the angle between the inner surface 804 of the platform 204 and the third axis 818. The third angle 822 may be different than the second angle 816 and the first angle 810.

During use, cooling medium may flow into the cooling system and out of the cooling openings 302 from a cooling medium supply source. The cooling medium may reduce the temperature of the platform 204 and local hot spot. The cooling medium may be exhausted through the downstream edge of the platform 204. The cooling medium may be a fluid and may form a layer of film cooling air immediately proximate to the outer surface of the platform 204. This configuration of the cooling system may cool the platform 204 with both external film cooling and internal convection. As a result, cooling fluids that cool internal aspects of the platform 204 with convective cooling also will cool external surfaces of the platform 204 with convective film cooling. Such use of the cooling fluids increases the efficiency of the cooling medium and reduces the temperature gradient of the platform 204 across its width. A potential additional benefit is that the more consistent cooling may allow the platform 204 to be created from less exotic materials that may be less costly.

Another advantage is that the first cooling openings 302 provide a cooling flow to additional cooling openings 304 such that the temperature at the additional cooling opening 304 will be lower. Thus, the additional cooling openings 304 will not have to cool such high temperatures. In addition, the cooling flows from the additional cooling openings 304 will be cooler and will be more effective at later cooling openings 306. Thus, hot spots on the platform 204 may be reduced resulting in more consistent cooling across the entire platform 204 which may result in a longer life for the platform 204.

The removal of material from the platform 204 results in the platform 204 weighing less. As the platform 204 weighs less, it may be easier to control and maintain. More specifically, as the turbine 18 is spinning at such a high rate of speed, the weight of the platform 204 becomes a great issue as the high speeds amplify the weight and create significantly more forces on the platform 204. By reducing the weight, the forces will be reduced on virtually all the moving parts related to the platform 204, from bearings to forces on the shaft of the turbine 18.

The described arrangement of cooling openings 202 improves the overall platform 204 cooling efficiency, provides more consistent platform 204 temperatures, reduces the platform 204 metal temperature, reduces platform 204 weight and reduces cooling fluid consumption. As a result, cooling fluids that cool internal aspects of the platform 204 with convective cooling also may cool external surfaces of the platform 204 with convective film cooling. Such use of the cooling fluids may increase the efficiency of the cooling fluids and reduces the temperature gradient of the platform 204 across its width.

A potential additional benefit is that the more consistent cooling may allow the platform 204 to be created from less exotic materials that may be less costly. As is known, finding materials are not overly heavy and that can withstand stress while part of the material is at a significantly different temperature is challenging. The difference in temperature causes varying thermal strains, which result in thermal mechanical fatigue. By creating a more uniform temperature over the platform 204, more materials may be able to withstand the stress and last longer.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A turbine used in a turbine engine comprising:

a turbine airfoil that is in communication with a platform for the turbine;

the platform comprising:

a first set of suction side openings extending between an inner surface and a top surface of the platform that exhaust a first cooling stream in the direction of a stream of airflow through the airfoil in communication with the platform when the turbine is at a desired velocity, each first suction side opening of the first set of suction side openings including a first axis, the first axis extending between the inner surface and the top surface of platform along the center of the first suction side opening, each first suction side opening of the first set of suction side openings further including a first angle, the first angle being defined as the angle between the inner surface of the platform and the first axis; and a second set of suction side openings extending between the inner surface and the top surface of the platform that exhaust a second cooling stream in the direction of the stream of airflow through the airfoil in communication with the platform when the turbine is at the desired velocity wherein the second set of suction side openings are located downstream of the first set of suction side openings relative to a flow direction of the first cooling stream along the top surface in a path of the first cooling stream and wherein the first cooling stream is adapted to cool the second set of suction side openings, each second suction side opening of the second set of suction side openings including a second axis, the second axis extending between the inner surface and the top surface of platform along the center of the second suction side opening, each second suction side opening of the second set of suction side openings further including a second angle, the second angle being defined as the angle between the inner surface of the platform and the second axis, the second angle less than the first angle.

2. The turbine of claim 1, the platform further comprising:

a third set of suction side openings extending between the inner surface and the top surface of the platform that exhaust a third cooling stream in the direction of the stream of airflow through the airfoil in communication with the platform when the turbine is at the desired velocity wherein the third set of suction side openings are located downstream of the second set of suction side openings relative to a flow direction of the second cooling stream along the top surface in the path of the second cooling stream and wherein the second cooling stream is adapted to cool the third set of suction side openings, each third suction side opening of the third set of suction side openings including a third axis, the third axis extending between the inner surface and the top surface of platform along the center of the third suction side opening, each third suction side opening of the third set of suction side openings further including a third angle, the third angle being defined as the angle between the inner surface of the platform and the third axis, the third angle less than the first angle and the second angle.

3. The turbine of claim 2, wherein the third set of suction side openings is in the path of the first cooling stream.

4. The turbine of claim 1, wherein the first set of suction side openings have a first diffuser adapted to provide control to the first cooling stream.

5. The turbine of claim 4, wherein the second set of suction side openings have a second diffuser adapted to provide control to the second cooling stream.

6. The turbine of claim 1, wherein the first set or second set of suction side openings is cylindrical.

7. The turbine of claim 1, wherein at least one of the first set of suction side openings and the second set of suction side openings are linear.

8. The turbine of claim 1, wherein at least one of the first set of suction side openings and the second set of suction side openings are curved.

9. The turbine of claim 1, wherein the first set of suction side openings is placed in an area of the platform that is hotter than a surrounding area of the platform at an operating temperature.

10. A method of creating a platform for a turbine for use in a turbine engine comprising:

creating a platform to accept at least one airfoil;

in the platform, i. forming a first set of suction side openings extending between an inner surface and a top surface of the platform that exhaust a first cooling stream in the direction of a stream of airflow through the at least one airfoil in communication with the platform when the turbine is at a desired velocity, each first suction side opening of the first set of suction side openings including a first axis, the first axis extending between the inner surface and the top surface of platform along the center of the first suction side opening, each first suction side opening of the first set of suction side openings further including a first angle, the first angle being defined as the angle between the inner surface of the platform and the first axis; and ii. forming a second set of suction side openings extending between an inner surface and a top surface of the platform that exhaust a second cooling stream in the direction of the stream of airflow through the airfoil in communication with the platform when the turbine is at the desired velocity wherein the second set of suction side openings are located downstream of the first set of suction side openings relative to a flow direction of the first cooling stream along the top surface in a path of the first cooling stream and wherein the first cooling stream is adapted to cool the second set of suction side openings, each second suction side opening of the second set of suction side openings including a second axis, the second axis extending between the inner surface and the top surface of platform along the center of the second suction side opening, each second suction side opening of the second set of suction side openings further including a second angle, the second angle being defined as the angle between the inner surface of the platform and the second axis, the second angle less than the first angle.

11. The method of claim 10, further comprising forming in the platform a third set of suction side openings that exhaust a third cooling stream in the direction of the stream of airflow through the airfoils in communication with the platform when the turbine is at the desired velocity wherein the third set of suction side openings are located downstream of the second set of suction side openings relative to a flow direction of the second cooling stream along the top surface in the path of the second cooling stream and wherein the second cooling stream is adapted to cool the third set of suction side openings, each third suction side opening of the third set of suction side openings including a third axis, the third axis extending between the inner surface and the top surface of platform along the center of the third suction side opening, each third suction side opening of the third set of suction side openings further including a third angle, the third angle being defined as the angle between the inner surface of the platform and the third axis, the third angle less than the first angle and the second angle.

12. The method of claim 11, wherein the third set of suction side openings is formed in the path of the first cooling stream.

13. The method of claim 10, further comprising forming a diffuser at the outlet of at least one of the first set of suction side openings and the second set of suction side openings wherein the diffuser controls the output from the opening.

14. The method of claim 10, further comprising forming at least one of the first set or second set of suction side openings to be cylindrical.

15. The method of claim 10, further comprising forming at least one of the first set or second set of suction side openings to be linear.

16. The method of claim 10, further comprising forming at least one of the first set or second set of suction side openings to be non-linear.

17. The method of claim 10, further comprising forming the first set of suction side openings in an area of the platform that is hotter than a surrounding area of the platform when the turbine is in operation.

* * * * *